US007273356B2

(12) United States Patent
Ochiai

(10) Patent No.: US 7,273,356 B2
(45) Date of Patent: Sep. 25, 2007

(54) CONTROL VALVE DEVICE FOR VARIABLE CAPACITY TYPE SWASH PLATE COMPRESSOR

(75) Inventor: Yoshihiro Ochiai, Isesaki (JP)

(73) Assignee: Sanden Corporation, Gunma (JP)

( * ) Notice: Subject to any disclaimer, the term of this patent is extended or adjusted under 35 U.S.C. 154(b) by 627 days.

(21) Appl. No.: 10/793,217

(22) Filed: Mar. 5, 2004

(65) Prior Publication Data

US 2004/0191077 A1 Sep. 30, 2004

(30) Foreign Application Priority Data

Mar. 28, 2003 (JP) ..... 2003-090598

(51) Int. Cl.
*F04B 1/26* (2006.01)

(52) U.S. Cl. ..... 417/222.2; 417/269

(58) Field of Classification Search ..... 417/222.2, 417/222.1, 269; 92/71; 62/228.3
See application file for complete search history.

(56) References Cited

U.S. PATENT DOCUMENTS

| | | | | |
|---|---|---|---|---|
| 5,018,366 | A | 5/1991 | Tanaka et al. | |
| 6,200,105 | B1 * | 3/2001 | Kawaguchi et al. | 417/222.2 |
| 6,386,834 | B1 * | 5/2002 | Kimura et al. | 417/222.2 |
| 6,524,077 | B2 * | 2/2003 | Suitou et al. | 417/222.2 |
| 2002/0069658 | A1 * | 6/2002 | Ota et al. | 62/228.5 |
| 2002/0094278 | A1 * | 7/2002 | Fukanuma et al. | 417/222.2 |
| 2002/0098091 | A1 * | 7/2002 | Umemura et al. | 417/222.2 |
| 2002/0112493 | A1 * | 8/2002 | Umemura et al. | 62/228.3 |
| 2002/0121828 | A1 | 9/2002 | Ketschau et al. | 310/190 |
| 2002/0131871 | A1 * | 9/2002 | Ota et al. | 417/222.1 |
| 2002/0144512 | A1 * | 10/2002 | Fukanuma et al. | 62/228.3 |
| 2002/0157410 | A1 * | 10/2002 | Suitou et al. | 62/228.3 |
| 2003/0021698 | A1 * | 1/2003 | Umemura et al. | 417/222.2 |
| 2004/0184925 | A1 * | 9/2004 | Ochiai | 417/222.2 |
| 2004/0191076 | A1 * | 9/2004 | Shiina | 417/222.2 |
| 2004/0191078 | A1 * | 9/2004 | Yoshihiro et al. | 417/222.2 |
| 2004/0202552 | A1 * | 10/2004 | Okii et al. | 417/222.2 |
| 2004/0253118 | A1 * | 12/2004 | Inoue et al. | 417/222.1 |
| 2005/0201867 | A1 * | 9/2005 | Hirota | 417/222.2 |
| 2005/0287014 | A1 * | 12/2005 | Umemura et al. | 417/222.1 |
| 2006/0083625 | A1 * | 4/2006 | Koyama et al. | 417/222.2 |
| 2006/0165534 | A1 * | 7/2006 | Umemura et al. | 417/222.2 |

FOREIGN PATENT DOCUMENTS

| | | |
|---|---|---|
| DE | 3903340 A1 | 8/1989 |
| EP | 0464370 | 1/1992 |
| JP | 0139300 | 5/1985 |
| JP | 0707182 | 4/1996 |
| JP | 2001107854 | 4/2001 |
| JP | 1236899 | 9/2002 |

* cited by examiner

*Primary Examiner*—William H. Rodriguez
(74) *Attorney, Agent, or Firm*—Baker Botts LLP

(57) ABSTRACT

There is disclosed a control valve device for a variable capacity type swash plate compressor for use in an air conditioning system. The device comprises an introducing passage for connecting a discharge chamber to a crank chamber in the compressor, and a control valve for adjusting a pressure in the crank chamber in an autonomous manner to control a discharge capacity of the compressor. The control valve includes a valve unit for opening/closing the introducing passage and an electromagnetic solenoid assembly for operating the valve unit. The control valve device further comprises a resistance variable mechanism for varying a resistance of the magnetic circuit in the assembly in accordance with a differential pressure of the refrigerant between two points defined between the compressor and a condenser of the system.

10 Claims, 2 Drawing Sheets

CONTROL VALVE DEVICE FOR VARIABLE CAPACITY TYPE SWASH PLATE COMPRESSOR

This Nonprovisional application claims priority under 35 U.S.C. 119(a) on patent application Ser. No. 2003-090598 filed in Japan on Mar. 27, 2003, the entire contents of which are hereby incorporated by reference.

BACKGROUND OF THE INVENTION

1. Field of the Invention

The present invention relates to a control valve device for a variable capacity type swash plate compressor, and the compressor is used in a refrigerating circuit of an air conditioning system disposed in a vehicle.

2. Description of the Related Art

A refrigerating circuit includes an evaporator and a condenser, and a variable capacity type swash plate compressor is disposed between the evaporator and condenser. This type of compressor is described, for example, in Japanese Unexamined Patent Publication No. 2001-107854. This known compressor has a crank chamber, and a swash plate is rotatably accommodated in the crank chamber. A tilt angle of the swash plate determines a discharge capacity of a refrigerant of the compressor, that is, reciprocating strokes of pistons in the compressor.

In this type of compressor, since the tilt angle of the swash plate is adjusted by a pressure in the crank chamber, the compressor includes an introducing passage connecting the crank chamber to a discharge chamber of the compressor, a release passage connecting the crank chamber to a suction chamber of the compressor and having an orifice, and a capacity control valve inserted in the introducing passage. The capacity control valve controls a flow rate of a high-pressure refrigerant introduced into the crank chamber from the discharge chamber, that is, the pressure in the crank chamber.

In more detail, the capacity control valve includes a valve unit and an electromagnetic solenoid assembly for operating the valve unit. The valve unit includes a valve member for opening/closing the introducing passage, and the valve member receives an electromagnetic force generated by the solenoid assembly in a closing direction of the valve member, while receiving an urging force based on a differential pressure of the refrigerant between two points defined between the compressor and condenser in an opening direction of the valve member.

Since the differential pressure of the refrigerant is an index indicating the discharge capacity from the compressor, the electromagnetic force is applied to the valve member in accordance with a target discharge capacity. Therefore, the valve member opens/closes the introducing passage so as to balance the electromagnetic force and urging force (discharge capacity). Accordingly, the pressure in the crank chamber is adjusted in an autonomous manner. It is to be noted that the target discharge capacity of the compressor is determined based on external information of a temperature setting switch or the like of the air conditioning system.

In general, the electromagnetic solenoid assembly includes a solenoid, movable and fixed cores forming a part of a magnetic circuit, and an operating rod connecting the movable core to the valve member of the valve unit, and the operating rod slidably extends through the fixed core.

The magnetic circuit has to generate only an axial electromagnetic force along an axial direction of the movable core or the operating rod. However, the magnetic circuit generates not only the axial electromagnetic force but also a radial electromagnetic force along a radial direction of the movable core because of a processing or assembling error of each component of the electromagnetic solenoid assembly, and the generation of the radial electromagnetic force cannot be avoided.

Moreover, the larger a cooling load of the air conditioning system, that is, the target discharge capacity of the compressor (the urging force of the valve member) is, the more axial electromagnetic force the electromagnetic solenoid assembly generates. Moreover, with the increase of the axial electromagnetic force, an undesired radial electromagnetic force also increases.

Since the large radial electromagnetic force biases the movable core in a radial direction, a sliding resistance of the operating rod with respect to the fixed core is not uniform in a peripheral direction of the operating rod. Therefore, abrasion of the outer peripheral surface of the operating rod proceeds only partially in the peripheral direction, this non-uniform abrasion obstructs stable sliding of the operating rod, and results in unstable opening/closing operation of the valve member in the valve unit.

SUMMARY OF THE INVENTION

An object of the present invention is to provide a control valve device for a variable capacity type swash plate compressor, which prevents non-uniform abrasion of an operating rod in a capacity control valve thereof and which is capable of maintaining stable opening/closing operation of the control valve.

To achieve the above-described object, there is provided a control valve device for a variable capacity type swash plate compressor installed in an air conditioning system, the control valve device comprising:

a refrigerant path permitting introduction and release of a refrigerant with respect to a crank chamber of the compressor, and including an introducing passage connecting a discharge chamber of the compressor to the crank chamber, and a release passage connecting the crank chamber to a suction chamber of the compressor;

a control valve inserted in one of the introducing passage and the release passage to control pressure in the crank chamber, said control valve including:

a valve unit having a valve member for opening/closing the one passage and a valve spring for urging the valve member in an opening or closing direction of the one passage, and an electromagnetic solenoid assembly operating the valve unit, and including a magnetic circuit for generating an electromagnetic force in a direction reverse to that of the urging force of the valve spring when a current is supplied, and having a fixed core, and an operating rod slidably extending in the fixed core to transmit the electromagnetic force to the valve member;

a resistance variable mechanism for varying a magnetic resistance of the magnetic circuit in accordance with a differential pressure of the refrigerant between two points defined in the air conditioning system; and control means for supplying a predetermined current to the electromagnetic solenoid assembly based on a target discharge capacity required for the compressor.

According to the above-described control valve device, the electromagnetic force of the magnetic circuit, that is, the axial electromagnetic force applied to the valve member via the operating rod is varied based on the magnetic resistance of the magnetic circuit determined by the differential pressure and the current supplied to the electromagnetic solenoid assembly. Moreover, the valve unit repeatedly opens/closes the introducing passage or the release passage based on the axial electromagnetic force varied in this manner and the urging force of the valve spring. As a result, the pressure in the crank chamber is adjusted in an autonomous manner, and an actual discharge capacity of the compressor is controlled so as to agree with the target discharge capacity.

Specifically, the current to be supplied to the electromagnetic solenoid assembly is determined in such a manner that the axial electromagnetic force of the magnetic circuit becomes substantially equal to the urging force of the valve spring, when the differential pressure agrees with a target differential pressure corresponding to the target discharge capacity.

In this case, since the valve member of the valve unit operates by a slight difference between the axial electromagnetic force and the urging force, by reducing the urging force of the valve spring, the axial electromagnetic force to be generated by the magnetic circuit can be reduced. Therefore, even when the magnetic circuit generates the above-mentioned radial electromagnetic force, the radial electromagnetic force is small, and smooth sliding of the operating rod is assured with respect to the fixed core. As a result, the abrasion of the operating rod is reduced, and the valve unit stably operates over a long period.

Specifically, the resistance variable mechanism includes a movable member which forms a part of the magnetic circuit and is adjacent to the fixed core with a magnetic gap from the fixed core and which receives the differential pressure in a direction for increasing the magnetic gap, and a return spring for urging the movable member in a direction for decreasing the magnetic gap.

In this case, when the differential pressure increases the magnetic gap, the magnetic resistance of the magnetic circuit increases, and the axial electromagnetic force of the magnetic circuit is reduced. On the other hand, when the differential pressure reduces the magnetic gap, the axial electromagnetic force of the magnetic circuit increases.

Specifically, the resistance variable mechanism further includes a passage which supplies a refrigerant pressure on a high-pressure side in the magnetic gap, and a chamber in which the return spring is housed and to which a refrigerant pressure on a low-pressure side is supplied. The magnetic gap and the chamber are formed independently of the inside of the valve unit.

The movable member is preferably slidably mounted on the operating rod. In this case, since the resistance variable mechanism is disposed between the electromagnetic solenoid assembly and the valve unit, the control valve can be miniaturized.

Furthermore, the resistance variable mechanism can further include a spacer disposed on the operating rod between the fixed core and the movable member, and this spacer is made of a nonmagnetic material, and defines a minimum value of the magnetic gap. Since the spacer constantly secures the magnetic gap between the fixed core and the movable member, the movable member can securely receive the differential pressure.

The control means can determine the target discharge capacity of the compressor based on external information.

Preferably the control valve is inserted in the introducing passage, and the valve spring urges the valve member in the opening direction. In this case, during stop of the operation of the air conditioning system, no current is supplied to the electromagnetic solenoid assembly, and the valve unit is maintained in an open position. Therefore, the discharge chamber is connected to the crank chamber, and the pressure in the crank chamber rises. This pressure rise reduces the tilt angle of the swash plate, that is, the discharge capacity of the compressor. As a result, an energy required for driving the compressor is saved.

The differential pressure can be obtained from refrigerant pressures of two points defined between the compressor and a condenser of the air conditioning system or defined in the compressor.

Further scope of applicability of the present invention will become apparent from the detailed description given hereinafter. However, it should be understood that the detailed description and specific examples, while indicating preferred embodiments of the invention, are given by way illustration only, since various changes and modification within the spirits and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
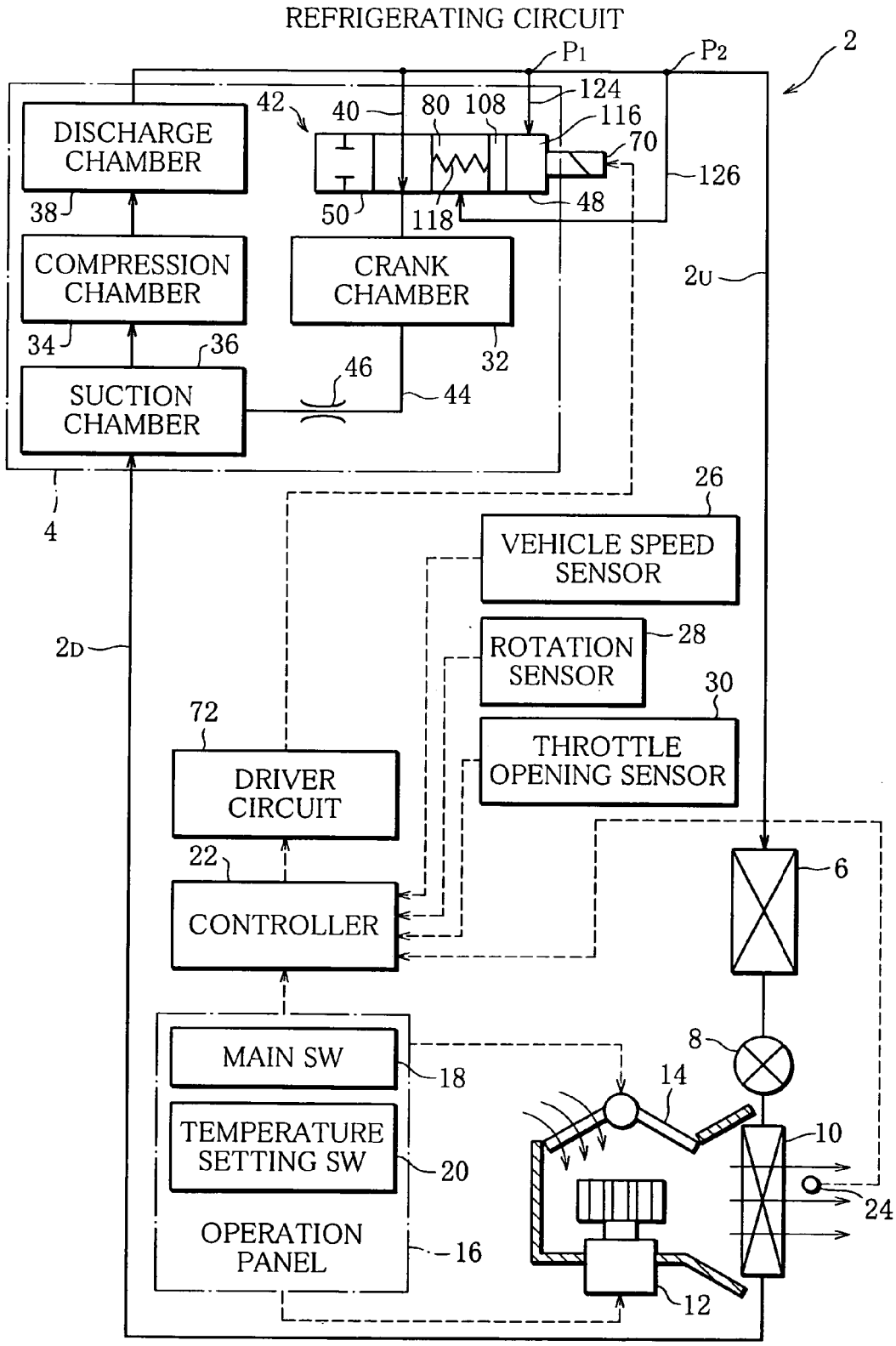
FIG. 1 is a schematic diagram showing a refrigerating circuit including a variable capacity type swash plate compressor provided with a control valve device of one embodiment.

As shown in FIG. 1, an air conditioning system of a vehicle includes a refrigerating circuit and the refrigerating circuit includes a circulation path 2 of a refrigerant. In this circulation path 2, a variable capacity type swash plate compressor 4, a condenser 6, an expansion valve 8 and evaporator 10 are arranged in this order.

The compressor 4 compresses the refrigerant, and discharges the compressed refrigerant toward the condenser 6. The condenser 6 condenses the supplied high-pressure refrigerant, and the liquefied refrigerant is supplied to the evaporator 10 through the expansion valve 8. The liquefied refrigerant is vaporized in the evaporator 10, and air around the evaporator 10 is cooled. Thereafter, the vaporized refrigerant is sucked into the compressor 4, and again compressed to circulate in the circulation path 2.

In order to introduce the cooled air into a passenger room of the vehicle, an air blower 12 and damper 14 are disposed in the vicinity of the evaporator 10. The damper 14 has an introduction position where outside air is introduced into the passenger room and a circulation position where the air is circulated in the passenger room, and is switched between the introduction position and the circulation position.

Furthermore, the air conditioning system includes an operation panel 16, and the operation panel 16 is disposed in an instrumental panel (not shown) in the passenger room. The operation panel 16 includes a main switch 18, a temperature setting switch 20 and the like for the air conditioning system, and these switches 18, 20 are electrically connected to a controller 22.

The controller 22 is also electrically connected to a temperature sensor 24, a vehicle speed sensor 26, a rotation sensor 28, and a throttle opening sensor 30. The temperature sensor 24 is disposed in the vicinity of the evaporator 10 to detect an air temperature in the passenger room. The vehicle speed sensor 26, rotation sensor 28 and throttle opening sensor 30 detect vehicle speed of the vehicle, rotation number of an engine of the vehicle, and opening of a throttle of the engine, respectively, as running states of the vehicle.

The controller 22 receives signal from the switches 18, 20 and sensors 24 to 30 to determine a target discharge capacity of the compressor 4. That is, the switches 18, 20 and sensors 24 to 26 supply the external information for determining the target discharge capacity of the compressor 4 to the controller 22.

Since the variable capacity type swash plate compressor 4 is already known from Japanese Unexamined Patent Publication No. 2001-107854, the compressor 4 will hereinafter be described briefly.

The compressor 4 includes a crank chamber 32, and a swash plate (not shown) is rotatably accommodated in the crank chamber 32. The swash plate is attached to a main shaft (not shown) of the compressor 4 at a variable tilt angle, and rotates integrally with the main shaft. The tilt angle of the swash plate is adjusted by the pressure in the crank chamber 32.

The rotation of the swash plate is converted to a reciprocation of a plurality of pistons (not shown), and a tail of each piston is engaged with an outer peripheral edge of the swash plate via a pair of shoes (not shown) for the conversion.

A head of the piston is inserted in a cylinder bore (not shown), and a compression chamber 34 is defined in the cylinder bore. The volume of the compression chamber 34 increases and decreases with the reciprocation of the piston. When the volume of the compression chamber 34 is increased, the refrigerant is sucked into the compression chamber 34 from a suction chamber 36, and the suction chamber 36 is connected to the evaporator 10 via a downstream portion $\mathbf{2}_D$ of the circulation path 2.

When the volume of the compression chamber 34 is reduced after the suction of the refrigerant, the sucked refrigerant is compressed in the compression chamber 34, and the high-pressure refrigerant is discharged to a discharge chamber 38 from the compression chamber 34. The discharge chamber 38 is connected to the condenser 6 via an upstream portion $\mathbf{2}_U$ of the circulation path 2.

In order to adjust the pressure in the crank chamber 32, the discharge chamber 38 is connected to the crank chamber 32 via an introducing passage 40 of the refrigerant, and a capacity control valve 42 is inserted in the introducing passage 40. On the other hand, the crank chamber 32 is connected to the suction chamber 36 via a release passage 44 of the refrigerant, and an orifice 46 is disposed in the release passage 44.

Figure 2:
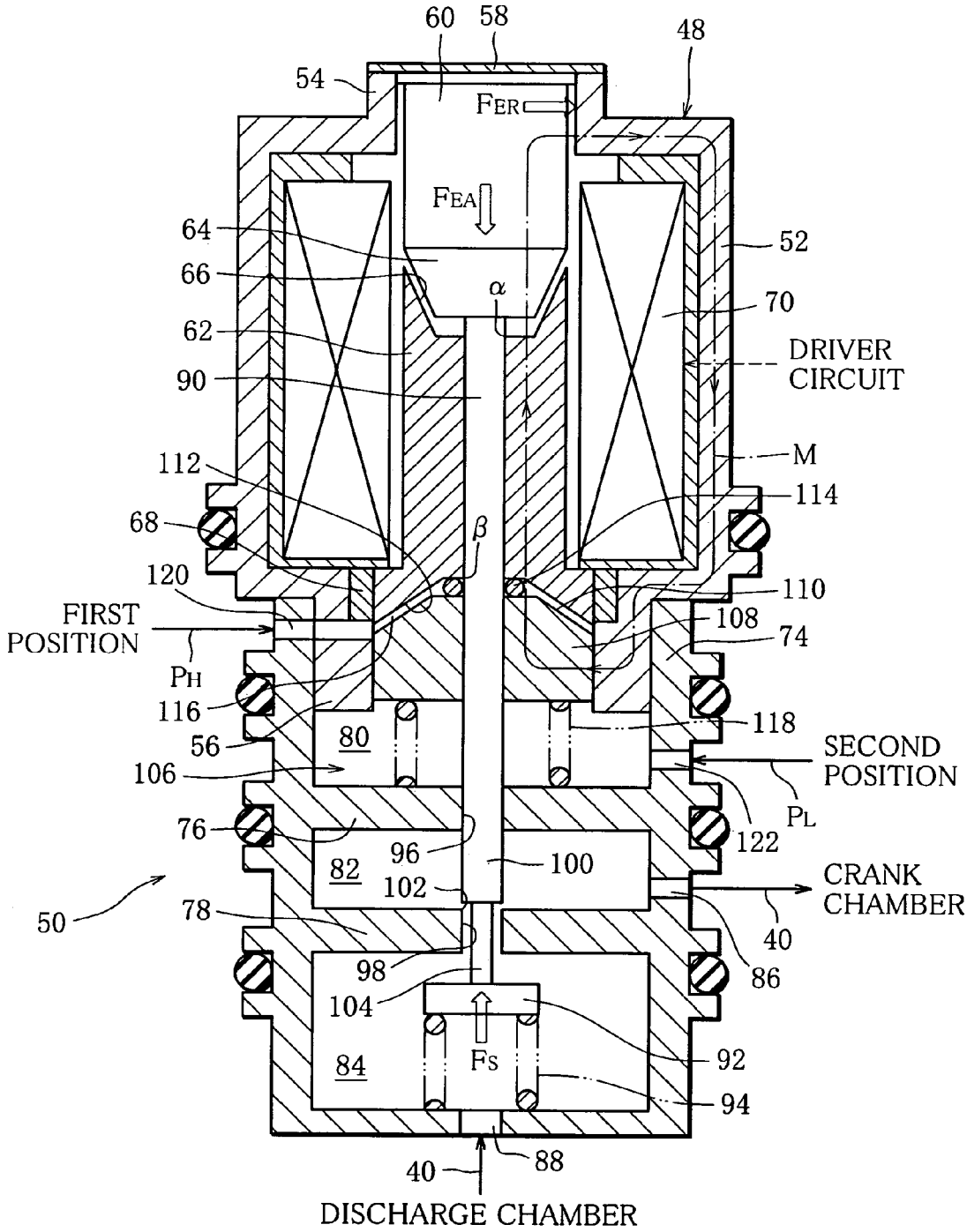
FIG. 2 is a longitudinal sectional view specifically showing a capacity control valve of FIG. 1.

As apparent from FIG. 1, the control valve 42 is constituted of an electromagnetic valve, and details are shown in FIG. 2.

The control valve 42 roughly includes an electromagnetic solenoid assembly 48 and a valve unit 50. The assembly 48 is provided with a cylindrical solenoid casing 52, and the solenoid casing 52 is made of a magnetic material.

Sleeves 54, 56 are protruded from opposite end faces of the solenoid casing 52, respectively, and these sleeves 54, 56 are integrally formed with the solenoid casing 52. The sleeve 54 is closed by an end plate 58. On the other hand, the sleeve 56 opens toward the valve unit 50.

A movable core 60 and fixed core 62 are housed in the solenoid casing 52, and these cores 60, 62 have cylindrical shapes. The cores 60, 62 are disposed on an axis of the solenoid casing 52, and are adjacent to each other.

In further detail, the movable core 60 is disposed on the side of the sleeve 54, and has one end in the vicinity of the end plate 58, and the other end in the vicinity of the fixed core 62. The other end of the movable core 60 is formed as a male taper 64 tapered toward the fixed core 62. On the other hand, the fixed core 62 has a female taper hole 66 capable of accepting the male taper 64 of the movable core 60 in one end surface.

Furthermore, the other end of the fixed core 62 is positioned in a base portion of the sleeve 56, and is fixed to the solenoid casing 52 via a nonmagnetic ring 68. Therefore, the other end of the fixed core 62 can never be magnetically connected to the solenoid casing 52.

A solenoid 70 is housed in the solenoid casing 52, and this solenoid 70 surrounds the outside of the movable core 60 and fixed core 62. As apparent from FIG. 1, the solenoid 70 is electrically connected to the controller 22 via a driver circuit 72.

The valve unit 50 is also provided with a valve casing 74, and the valve casing 74 is made of a nonmagnetic material. The valve casing 74 has a cylindrical shape, and has one end opened and the other end closed The one end of the valve casing 74 receives the sleeve 56 of the solenoid casing 52, and accordingly the casings 74, 52 are connected to each other.

The valve casing 74 has two partition walls 76, 78 inside, and these partition walls 76, 78 define three chambers 80, 82, 84 in the valve casing 74. These chambers 80, 82, 84 are successively arranged from the side of the solenoid casing 52.

An outlet port 86 communicating with the chamber 82 is formed in an outer peripheral wall of the valve casing 74, and the outlet port 86 is connected to the crank chamber 32 via a downstream portion of the introducing passage 40. On the other hand, an inlet port 88 communicating with the chamber 84 is formed in the closed end wall of the valve casing 74, and the inlet port 88 is connected to the discharge chamber 38 via an upstream portion of the introducing passage 40.

On the other hand, an operating rod 90 is disposed in the solenoid casing 52 and valve casing 74 and extends on the axis of these casings. The operating rod 90 has one end connected to the male taper 64 of the movable core 60, slidably extends through the fixed core 62 from the male taper 64, and extends into the valve casing 74.

In more detail, the operating rod 90 extends through the partition walls 76, 78 in the valve casing 74, and has the other end positioned in the chamber 84. A disc-shaped spring seat 92 is attached to the other end of the operating rod 90, and a compression coil spring, that is, a valve spring 94 is disposed between the spring seat 92 and a inner end face of the chamber 84 or the closed end wall of the casing 74. The valve spring 94 urges the operating rod 90 toward the solenoid casing 52 side.

As apparent from FIG. 2, the partition wall 76 has a through hole 96 for slidably passing the operating rod 90, and the partition wall 78 has a valve hole 98 for connecting the chamber 82 to the chamber 84. The valve hole 98 has a diameter smaller than that of the through hole 96, and is opened/closed by the operating rod 90.

That is, the operating rod 90 positioned in the chamber 82 is formed as a valve member 100. On the other hand, an opening edge of the valve hole 98 on the chamber 82 side is formed as a valve seat 102 which cooperates with the valve member 100. Furthermore, a portion of the operating rod 90 between the valve member 100 and the spring seat 92 is formed as a valve rod portion 104 having a diameter smaller than that of the valve hole 98, and the valve rod portion 104 passes through the valve hole 98 to connect the valve member 100 to the spring seat 92.

In a state shown in FIG. 1, the operating rod 90, that is, the valve member 100 undergoes an urging force $F_S$ of the valve spring 94, and is lifted from the valve seat 102. Therefore, the valve hole 98 is opened, and the discharge chamber 38 is connected to the crank chamber 32 via the valve unit 50.

Meanwhile, when a driving signal is supplied to the solenoid 70 of the electromagnetic solenoid assembly 48, a magnetic circuit is formed in the solenoid assembly 48. The magnetic circuit generates an axial electromagnetic force $F_{EA}$ in the axial direction of the solenoid casing 52, and the axial electromagnetic force $F_{EA}$ pushes out the operating rod 90 toward the valve unit 50 via the movable core 60. Therefore, the valve member 100 abuts on the valve seat 102 against the urging force $F_S$ of the valve spring 94 to close the valve hole 98. As a result, the discharge chamber 38 is disconnected from the crank chamber 32 by the valve unit 50.

The electromagnetic solenoid assembly 48 further includes a magnetic resistance variable mechanism 106 for varying the magnetic resistance of the magnetic circuit, and the variable mechanism 106 will hereinafter be described in detail.

The variable mechanism 106 includes a movable plug 108 slidably mounted on the operating rod 90. The movable plug 108 has a cylindrical shape, and is slidably fitted into the sleeve 56 of the solenoid casing 52. Furthermore, the movable plug 108 is made of the magnetic material, and forms a part of a magnetic path for the magnetic circuit.

One end of the movable plug 108 on the fixed core 62 side is formed as a male taper surface 110 tapered toward the fixed core 62. On the other hand, the other end surface of the fixed core 62 is formed as a female taper surface 112 matched with the male taper surface 110.

An annular spacer 114 is disposed between the taper surfaces 110, 112, and the spacer 114 secures a gap chamber 116 between the taper surfaces 110, 112. The spacer 114 is made of the nonmagnetic material, and accordingly the gap chamber 116 forms the magnetic gap in the magnetic circuit. It is to be noted that the operating rod 90 slidably extends through the spacer 114.

Furthermore, the compression coil spring, that is, a plug spring 118 is housed as the return spring therefor in the chamber 80. The plug spring 118 is disposed between the movable plug 108 and the partition wall 76, and urges the movable plug 108 toward the fixed core 62.

A communicating port 120 communicating with the gap chamber 116 is formed in the lap area between one end of the sleeve 56 and valve casing 74, and this communicating port 120 is connected to a first position $P_1$ of an upstream portion $2_U$ in the circulation path 2. Furthermore, a communicating port 122 communicating with the chamber 80 is formed in the outer peripheral wall of the valve casing 74, and this communicating port 122 is also connected to a second position $P_2$ of the upstream portion $2_U$.

In more detail, as shown in FIG. 1, the gap chamber 116 is connected to the first position $P_1$ via a passage 124, and the chamber 80 is connected to the second position $P_2$ via a passage 126. The first and second positions $P_1$, $P_2$ are defined by the circulation path 2 between the compressor 4 and the condenser 6, and the second position $P_2$ is positioned in the downstream of the first position $P_1$. Therefore, an upstream pressure $P_H$ of the high-pressure refrigerant in the first position $P_1$ is supplied to the gap chamber 116, and a downstream pressure $P_L$ of the high-pressure refrigerant in the second position $P_2$ is supplied to the chamber 80.

The operation of the capacity control valve 42 is as follows.

Now the compressor 4 is driven by the engine of the vehicle, but it is assumed that the air conditioning system is not operated.

Since the electromagnetic solenoid assembly 48 is not operated before the starting of the air conditioning system, the valve member 100 of the valve unit 50 opens the valve hole 98 by the urging force $F_S$ of the valve spring 94. Therefore, since the discharge chamber 38 of the compressor 4 is connected to the crank chamber 32 via the valve unit 50, the high-pressure refrigerant is supplied to the crank chamber 32 from the discharge chamber 38, and the pressure in the crank chamber 32 is raised.

The pressure rise in the crank chamber 32 results in the reduction of the tilt angle of the swash plate, and accordingly the discharge capacity of the compressor 4 is reduced. That is, the compressor 4 is driven in a minimum discharge capacity before the starting of the air conditioning system.

Meanwhile, as described above, the upstream pressure $P_H$ and downstream pressure $P_L$ of the refrigerant are supplied to the gap chamber 116 of the electromagnetic solenoid assembly 48 and the chamber 80 of the valve unit 50, respectively. When the discharge capacity of the compressor 4 indicates a minimum value, an actual differential pressure $\Delta P_A$ ($=P_H-P_L$) between the upstream pressure $P_H$ and the downstream pressure $P_L$ is substantially zero. Therefore, the movable plug 108 is moved toward the fixed core 62 by the urging force of the plug spring 118, and the volume of the gap chamber 116 is maintained to be minimum.

Then, when the air conditioning system is started, the controller 22 obtains a target discharge capacity of the compressor 4, that is, a target differential pressure $\Delta P_O$ to be generated between the upstream pressure $P_H$ and the downstream pressure $P_L$. Thereafter, the controller 22 determines a current I to be supplied to the solenoid 70 of the electromagnetic solenoid assembly 48 based on the target differential pressure $\Delta P_O$, and supplies the current I to the solenoid 70.

Therefore, a magnetic circuit M is formed in the electromagnetic solenoid assembly 48 as shown by a one-dot chain line in FIG. 2, and the magnetic path of the magnetic circuit M passes through the movable plug 108 and gap chamber 116. This magnetic circuit M generates the axial electromagnetic force $F_{EA}$, and the axial electromagnetic force $F_{EA}$ moves the movable core 60 and operating rod 90 toward the valve unit 50. Therefore, the valve member 100 of the valve unit 50 abuts on the valve seat 102 against the urging force $F_S$ of the valve spring 94 to close the valve hole 98. At this time, the discharge chamber 38 is disconnected from the crank chamber 32, and the supply of the high-pressure refrigerant into the crank chamber 32 from the discharge chamber 38 is stopped.

Meanwhile, the crank chamber 32 is communicated with the suction chamber 36 via the release passage 44 including the orifice 46 as described above. Therefore, when the supply of the high-pressure refrigerant into the crank chamber 32 is stopped, the pressure in the crank chamber 32 gradually drops. The pressure drop in the crank chamber 32 increases the tilt angle of the swash plate, that is, the discharge capacity of the compressor 4.

The increase of the discharge capacity of the compressor 4 causes the rise of the actual differential pressure $\Delta P_A$, the rise of the actual differential pressure $\Delta P_A$ moves the movable plug 108 against the urging force of the plug spring 118, and the volume of the gap chamber 116, that is, the magnetic gap formed between the fixed core 62 and the movable plug 108 is increased.

By the increase of the magnetic gap, the axial electromagnetic force $F_{EA}$ is reduced, although the current I supplied to the solenoid 70 is maintained to be constant. Then, when the axial electromagnetic force $F_{EA}$ becomes smaller than the urging force $F_S$ of the valve spring 94, the valve member 100 opens the valve hole 98, and the supply of the high-pressure refrigerant to the crank chamber 32 from the discharge chamber 38 is restarted.

When the supply of the high-pressure refrigerant is restarted, the pressure in the crank chamber 32 rises, and the discharge capacity of the compressor 4 decreases. Therefore, since the actual differential pressure $\Delta P_A$, that is, the magnetic gap decreases, the axial electromagnetic force $F_{EA}$ increases again, and the valve member 100 closes the valve hole 98 again.

That is, the opening/closing operation of the valve member 100 is repeated to adjust the pressure in the crank chamber 32 in the autonomous manner so that the actual differential pressure $\Delta P_A$ (discharge capacity of the compressor 4) is matched with the target discharge pressure $\Delta P_O$ (target discharge capacity).

As apparent from the above description, the current I supplied to the solenoid 70 is determined in such a manner that the reduced axial electromagnetic force $F_{EA}$ is substantially equal to the urging force $F_S$ of the valve spring 94 in consideration of the amount of the axial electromagnetic force $F_{EA}$ reduced by the magnetic gap at a time when the actual differential pressure $\Delta P_A$ agrees with the target discharge pressure $\Delta P_O$.

It is to be noted that for pressure receiving surfaces of the operating rod 90 for receiving the pressure in the chamber 84 in opposite directions, the areas of the pressure receiving surfaces differ from each other. Therefore, the force is exerted in the valve member 100 in the direction for opening the valve hole 98 because of an area difference between the pressure receiving surfaces, but this force is sufficiently smaller than the urging force $F_S$, and the determination of the current I is not influenced.

The actual differential pressure $\Delta P_A$ is not applied to the valve member 100, and the opening/closing operation of the valve member 100, that is, the sliding of the operating rod 90 with respect to the fixed core 62 is limited to a time when the axial electromagnetic force $F_{EA}$ fluctuates centering on the urging force $F_S$. Thereafter, the urging force $F_S$ of the valve spring 94, that is, the axial electromagnetic force $F_{EA}$ required for the magnetic circuit M can be set to be as small as possible.

Since the axial electromagnetic force $F_{EA}$ is small in this manner, even when a radial electromagnetic force $F_{ER}$ is generated from the magnetic circuit M in the radial direction of the movable core 60, the radial electromagnetic force $F_{ER}$ is also very small. As a result, the operating rod 90 can smoothly slide with respect to the fixed core 62, the abrasion of the outer peripheral surface of the operating rod 90 is not non-uniform, and the stable opening/closing operation of the valve member 100 is assured. It is to be noted that when the movable core 60 receives the radial electromagnetic force $F_{ER}$, the operating rod 90 is pressed onto the fixed core 62 in each of $\alpha$ and $\beta$ points shown in FIG. 2.

Since the urging force $F_S$ of the valve spring 94 acts in a direction for opening the valve member 100, the valve unit 50 is maintained in the open position after stopping the operation of the air conditioning system. In this case, the discharge chamber 38 maintained in a state communicating with the crank chamber 32, the pressure in the crank chamber 32 rises, and the discharge capacity of the compressor 4 is maintained at a minimum value. As a result, since the external energy required for driving the compressor 4 is reduced during stop of the operation of the air conditioning system, the output of the engine is not wasted, and fuel efficiency of the engine can be enhanced.

The present invention is not restricted to the above-described embodiment, and can variously be modified.

For example, the movable plug 108 of the capacity control valve 42 can also receive the differential pressure generated between two points in the compressor 4 instead of the actual differential pressure $\Delta P_A$. As the differential pressure in this case, the differential pressure ($=P_D-P_S$) between a discharge pressure $P_D$ of the discharge chamber 38 and a suction pressure $P_S$ of the suction chamber 36, the differential pressure ($=P_c-P_S$) between an inner pressure $P_C$ of the crank chamber 33 and the suction pressure $P_S$, or the differential pressure ($=P_{SH}-P_{SL}$) between two points in the suction chamber 36 can be used.

Moreover, the valve unit 50 of the capacity control valve 42 can have as a valve member a valve spool switched between an introduction position where the refrigerant is introduced into the crank chamber 32 from the discharge chamber 38 and a release position where the refrigerant is released to the suction chamber 36 from the crank chamber 32. In this case, the release passage 44 having the orifice 46 may be omitted.

What is claimed is:

1. A control valve device for a variable capacity type swash plate compressor for use in an air conditioning system, the compressor including a suction chamber of a refrigerant, a discharge chamber of the refrigerant, and a crank chamber in which a swash plate is accommodated, a tilt angle of the swash plate determining a discharge capacity of the compressor and being adjusted by a pressure in the crank chamber, the control valve device comprising:

a refrigerant path permitting introduction and release of the refrigerant with respect to the crank chamber, and including an introducing passage connecting the discharge chamber to the crank chamber and a release passage connecting the crank chamber to the suction chamber;

a control valve inserted in one of the introducing passage and the release passage to control the pressure in the crank chamber, said control valve including:

a valve unit having a valve member for opening/closing said one passage and a valve spring for urging the valve member in an opening or closing direction of said one passage;

and an electromagnetic solenoid assembly operating said valve unit, and including a magnetic circuit for generating an electromagnetic force of a direction reverse to that of the urging force of the valve spring when a current is supplied, and having a fixed core, and an operating rod slidably extending through the fixed core to transmit the electromagnetic force to the valve member;

a resistance variable mechanism for varying a magnetic resistance of the magnetic circuit in accordance with a differential pressure of the refrigerant between two points defined in the air conditioning system; and control means for supplying a predetermined current to said electromagnetic solenoid assembly based on a target discharge capacity required for the compressor.

2. A control valve device for a variable capacity type swash plate compressor for use in an air conditioning system, the compressor including a suction chamber of a refrigerant, a discharge chamber of the refrigerant, and a crank chamber in which a swash plate is accommodated, a tilt angle of the swash plate determining a discharge capacity of the compressor and being adjusted by a pressure in the crank chamber, the control valve device comprising:

a refrigerant path permitting introduction and release of the refrigerant with respect to the crank chamber, and including an introducing passage connecting the discharge chamber to the crank chamber and a release passage connecting the crank chamber to the suction chamber;

a control valve inserted in one of the introducing passage and the release passage to control the pressure in the crank chamber, said control valve including:

a valve unit having a valve member for opening/closing said one passage and a valve spring for urging the valve member in an opening or closing direction of said one passage;

and an electromagnetic solenoid assembly operating said valve unit, and including a magnetic circuit for generating an electromagnetic force of a direction reverse to that of the urging force of the valve spring when a current is supplied, and having a fixed core, and an operating rod slidably extending through the fixed core to transmit the electromagnetic force to the valve member;

a resistance variable mechanism for varying a magnetic resistance of the magnetic circuit in accordance with a differential pressure of the refrigerant between two points defined in the air conditioning system, said resistance variable mechanism includes:

a movable member for forming a part of the magnetic circuit, the movable member being adjacent to the fixed core with a magnetic gap from the fixed core, and receiving the differential pressure in a direction for increasing the magnetic gap; and a return spring for urging the movable member in a direction for decreasing the magnetic gap; and control means for supplying a predetermined current to said electromagnetic solenoid assembly based on a target discharge capacity required for the compressor.

3. The device according to claim 2, wherein said resistance variable mechanism further includes a passage for receiving a refrigerant pressure on a high-pressure side of the system in the magnetic gap, and a chamber in which the return spring is housed, for receiving a refrigerant pressure on a low-pressure side of the system, the pressures of the high- and low-pressure sides producing the differential pressure, and the magnetic gap and the chamber are located independently of the inside of the valve unit.

4. The device according to claim 3, wherein the movable member is slidably mounted on the operating rod.

5. The device according to claim 4, wherein said resistance variable mechanism further includes a spacer disposed on the operating rod between the fixed core and the movable member, and the spacer is made of a nonmagnetic material, and defines a minimum value of the magnetic gap.

6. The device according to claim 1, wherein said control means determines the target discharge capacity of the compressor based on external information.

7. The device according to claim 2, wherein the control means determines a current to be supplied to said assembly in such a manner that an electromagnetic force of the magnetic circuit determined by the current and the magnetic gap becomes substantially equal to the urging force of the valve spring, when an actual discharge capacity of the compressor agrees with the target discharge capacity.

8. The device according to claim 1, wherein said control valve is inserted in the introducing passage, and the valve spring urges the valve member in the opening direction thereof.

9. The device according to claim 1, wherein the differential pressure is obtained from refrigerant pressures of two points defined between the compressor and a condenser of the air conditioning system.

10. The device according to claim 1, wherein the differential pressure is obtained from refrigerant pressures of two points defined in the compressor.

* * * * *